US007281536B1

(12) United States Patent
Shibuya

(10) Patent No.: US 7,281,536 B1
(45) Date of Patent: Oct. 16, 2007

(54) CUTTING MACHINE USING WIRE SAW, CUTTING METHOD USING WIRE SAW, AND MOBILE MACHINE HAVING WIRE SAW CUTTING MACHINE

(75) Inventor: Shouichi Shibuya, Niyagi (JP)

(73) Assignee: Shibushou Construction Co., Ltd. (JP)

( * ) Notice: Subject to any disclaimer, the term of this patent is extended or adjusted under 35 U.S.C. 154(b) by 0 days.

(21) Appl. No.: 11/391,308

(22) Filed: Mar. 29, 2006

(51) Int. Cl.
*B28D 1/08* (2006.01)

(52) U.S. Cl. ..... 125/21; 125/14; 125/16.01; 30/393

(58) Field of Classification Search ..... 125/14, 125/16.01, 16.02, 15, 19, 21; 30/393; 51/59, 51/263
See application file for complete search history.

(56) References Cited

U.S. PATENT DOCUMENTS 4,832,411 A 5/1989 Johnston et al.
4,893,607 A 1/1990 Kubo
5,173,250 A 12/1992 Ichikawa et al.
5,193,518 A 3/1993 Moller et al.
5,329,562 A 7/1994 Kubo et al.
5,699,783 A * 12/1997 Kubo ..... 125/21
6,598,597 B1 * 7/2003 Marocco et al. ..... 125/16.01
6,881,131 B2 * 4/2005 Parsells et al. ..... 451/53

FOREIGN PATENT DOCUMENTS

JP 07-189502 7/1995

* cited by examiner

*Primary Examiner*—Joseph J. Hail, III
*Assistant Examiner*—Anthony Ojini
(74) *Attorney, Agent, or Firm*—Bacon & Thomas, PLLC

(57) ABSTRACT

A cutting apparatus that positions a wire saw driving device movably and appropriately at the desired site by freely moving an arm of a backhoe provided with a boom, which arm carries the wire saw driving device and is turnable and movable in upward, downward, leftward, rightward, forward, and backward directions, thus enabling cutting at sites too narrow in which to use a conventional machine. Cutting by use of a wire saw and by use of a disk blade can be alternately performed as needed.

13 Claims, 4 Drawing Sheets

CUTTING MACHINE USING WIRE SAW, CUTTING METHOD USING WIRE SAW, AND MOBILE MACHINE HAVING WIRE SAW CUTTING MACHINE

BACKGROUND OF THE INVENTION

1. Field of the Invention

The present invention relates to a wire saw cutting apparatus suitable for use when a steel framed reinforced concrete structure or a similar structure is cut by use of a wire saw, relates to a wire saw cutting method, and relates to a mobile machine provided with a cutting apparatus used both as a rotary disk saw and as a wire saw.

2. Description of the Prior Art

It is generally performed to cut a concrete structure or a similar structure by use of a wire saw. The wire saw, which is endless, is to cut an object by a frictional force while being passed via a driving source, a guide pulley, and the object to be cut. The wire saw is gradually loosened proportionately with the progress of the cutting operation. Therefore, to reduce the amount of wire looseness, a conventional way has been employed in which the position of, for example, a guide sheave, etc., is appropriately adjusted to maintain a constant tensional state.

By the way, such a object to be cut does not always lie at a flat place, and hence a mechanical structure in which a wire saw cutting apparatus is mounted on a crawler machine is known as a conventional one.

A system having this known structure does not have much difficulty in moving on the rugged ground, because the crawler mechanism is provided. The looseness of the wire saw is corrected by arranging the wire saw cutting apparatus movably with respect to the crawler machine.

However, for example, if a cutting operation must be performed in such a narrow space that the crawler machine cannot be placed around a object to be cut constructed of concrete, and if the crawler machine must be placed far from the object to be cut or must be placed thereover whenever the cutting operation is performed, many other guide sheaves must be prepared for the wire saw of the wire saw apparatus. Therefore, disadvantageously, much time is needed for arrangement, and costs are raised.

By the way, in the conventional wire saw cutting apparatus, the cutting area of the wire saw is gradually narrowed at about the end of the cutting-operation period, so that bending stress on the wire saw is sharply caused. As a result, excessive stress is imposed on the wire saw, and, in the worst case, there is a possibility that the wire saw will be cut and broken. Therefore, to ease such stress, conventional measures have been carried out in such a way that, for example, guide sheaves, etc., are attached to the forward part and the backward part, respectively, of the cutting section of the wire saw so as not to cause a sharp bend, and the stress of the wire saw is eased while the wire saw is being guided by the guide sheaves.

However, disadvantageously, the cutting operation cannot be easily performed if there is no ample space at the place where an object is cut although the above-mentioned measures will be effective if there is an ample space there.

By the way, many large and small secondary products are required to be cut in accordance with the size of a construction work site where construction work is performed by use of secondary concrete products. If a conventional wire saw cutting apparatus is used, the place where the apparatus is disposed is needed even when small-scale construction work is performed, and hence the efficiency of the cutting operation is lowered. Therefore, a cutting apparatus provided with a disk blade is needed. However, according to a conventional method, a wire saw type driving source and a disk blade type driving source are provided independently of each other, and hence an immediate act cannot be carried out when both a cutting operation with the wire saw and a cutting operation with the disk blade must be performed at the construction work site. Additionally, a soil excavation must also be performed at the construction work site. Thus, still another problem resides in the fact that, to introduce many special machines at the small-scale construction work site, an estimated cost rises, and a sufficient space cannot be secured.

SUMMARY OF THE INVENTION

It is a primary object of the present invention to provide a cutting apparatus that can set a wire saw driving device movably and appropriately at a desired site by freely moving an arm of the apparatus of the present invention and by attaching the wire saw driving device onto the acting side, i.e., onto the end of an arm of a mobile machine provided with a boom and an arm, such as a backhoe provided with a crawler machine, which is turnable and movable in upward, downward, leftward, rightward, forward, and backward directions even if a place near a object to be cut, such as a concrete structure, is too narrow to dispose a conventional cutting apparatus.

It is another object of the present invention to provide a cutting apparatus having a structure in which a cutting operation by use of a wire saw and a cutting operation by use of a disk blade can be alternately performed at need and in which a suitable driving source can be replaced as an attachment for operations.

The present invention is a wire saw cutting apparatus characterized in that a wire saw driving device is attached to an acting end side of an arm of a mobile machine provided with a boom and the arm turnable and movable in upward, downward, leftward, rightward, forward, and backward directions.

In the wire saw cutting apparatus in which a wire saw driving device is attached to an acting end side of an arm of a mobile machine provided with a boom and the arm turnable and movable in upward, downward, leftward, rightward, forward, and backward directions, a feature of the present invention resides in the fact that a base having the wire saw driving device is detachably attached to the end of the arm, and the base and the arm end are provided rotatably upon a shaft center and perpendicularly thereto and/or at an arbitrary angle therewith so that a rotational plane of a driving sheave of a wire saw of the wire saw driving device can be changed to be perpendicular thereto and/or at an arbitrary angle therewith.

In the wire saw cutting apparatus in which a wire saw driving device is attached to an acting end side of an arm of a mobile machine provided with a boom and the arm turnable and movable in upward, downward, leftward, rightward, forward, and backward directions, a feature of the present invention resides in the fact that a base having the wire saw driving device is detachably attached to the end of the arm, the fact that the base and the arm end are provided rotatably upon a shaft center and perpendicularly thereto and/or at an arbitrary angle therewith so that a rotational plane of a driving sheave of a wire saw of the wire saw driving device can be changed to be perpendicular thereto and/or at an arbitrary angle therewith, and the fact that an oil hydraulic motor is used as a driving source of the wire saw driving device, whose oil pressure source is extracted from the mobile machine.

Further, the present invention is a method for cutting a object to be cut by use of a wire saw by attaching a wire saw driving device to an acting end side of an arm of a mobile machine provided with a boom and the arm turnable and movable in upward, downward, leftward, rightward, forward, and backward directions.

In the method for cutting a object to be cut by use of a wire saw by attaching a wire saw driving device to an acting end side of an arm of a mobile machine provided with a boom and the arm turnable and movable in upward, downward, leftward, rightward, forward, and backward directions, a feature of the present invention resides in the fact that a base having the wire saw driving device is detachably attached to the end of the arm, the fact that a wire saw oil pressure driving device is used in which the base and the arm end are provided rotatably upon a shaft center and perpendicularly thereto and/or at an arbitrary angle therewith so that a rotational plane of a driving sheave of a wire saw of the wire saw driving device can be changed to be perpendicular thereto and/or at an arbitrary angle therewith, and the fact that the wire saw is driven while being set to have an arbitrary angle in accordance with an angle of the driving sheave, and looseness of the wire saw is removed under oil pressure control by finely adjusting the boom and the arm from a driver's seat when the wire saw is loosened.

Further, the present invention is a mobile machine provided with a cutting apparatuses, the mobile machine being characterized in that a wire saw cutting apparatus and a disk cutting apparatus are replaceably connected to an arm acting side of the mobile machine having a boom and an arm turnable and movable in upward, downward, leftward, rightward, forward, and backward directions, characterized in that an oil hydraulic motor disposed in each of the cutting apparatuses is rotationally driven by an oil pressure driving source disposed in the mobile machine, and characterized in that roll control and operations of the boom and the arm are performed from a driver's seat disposed in the mobile machine.

In the present invention, a wire saw driving device is attached to an acting end side of an arm of a mobile machine provided with a boom and the arm turnable and movable in upward, downward, leftward, rightward, forward, and backward directions. Therefore, a wire saw can be mounted on the wire saw driving device and be passed around a object to be cut so as to cut the object as a matter of course, and simplification can be achieved without mounting a wire saw driving source and a wire saw movement control unit on the wire saw cutting apparatus itself. Therefore, the wire saw driving device can be used as an attachment of the mobile machine, and space saving for storage can be achieved.

In the wire saw cutting apparatus of the present invention in which a wire saw driving device is attached to an acting end side of an arm of a mobile machine provided with a boom and the arm turnable and movable in upward, downward, leftward, rightward, forward, and backward directions, a base having the wire saw driving device is detachably attached to the end of the arm, and the base and the arm end are provided rotatably upon a shaft center and perpendicularly thereto and/or at an arbitrary angle therewith so that a rotational plane of a driving sheave of a wire saw of the wire saw driving device can be changed to be perpendicular thereto and/or at an arbitrary angle therewith. Therefore, a wire saw can be mounted on the wire saw driving device and be passed around a object to be cut so as to cut the object, and simplification can be achieved without mounting a wire saw driving source and a wire saw movement control unit on the wire saw cutting apparatus. Therefore, the wire saw driving device can be used as an attachment of the mobile machine, and space saving for storage can be achieved as a matter of course. Additionally, the wire saw driving device itself can change its arbitrary angle with respect to a wire saw cutting plane, and hence an oblique cutting operation can be performed, and a cutting apparatus having flexibility can be provided.

Further, in the wire saw cutting apparatus of the present invention in which a wire saw driving device is attached to an acting end side of an arm of a mobile machine provided with a boom and the arm turnable and movable in upward, downward, leftward, rightward, forward, and backward directions, a base having the wire saw driving device is detachably attached to the end of the arm, the base and the arm end are provided rotatably upon a shaft center and perpendicularly thereto and/or at an arbitrary angle therewith so that a rotational plane of a driving sheave of a wire saw of the wire saw driving device can be changed to be perpendicular thereto and/or at an arbitrary angle therewith, and an oil hydraulic motor is used as a driving source of the wire saw driving device, whose oil pressure source is extracted from the mobile machine. Therefore, a wire saw can be mounted on the wire saw driving device and be passed around a object to be cut so as to cut the object, and simplification can be achieved without mounting a wire saw driving source and a wire saw movement control unit on the wire saw cutting apparatus itself. Therefore, the wire saw driving device can be used as an attachment of the mobile machine, and space saving for storage can be achieved as a matter of course. Additionally, the wire saw driving device itself can change its arbitrary angle with respect to a wire saw cutting plane, and hence an oblique cutting operation can be performed, and a cutting apparatus having flexibility can be provided. Still additionally, since employing the oil hydraulic motor can reduce noise, noise caused in construction work can be reduced.

Further, the present invention is the method for cutting a object to be cut by use of a wire saw by attaching a wire saw driving device to an acting end side of an arm of a mobile machine provided with a boom and the arm turnable and movable in upward, downward, leftward, rightward, forward, and backward directions. Therefore, even in a situation in which a space wide enough to dispose a conventional concrete-cutting apparatus cannot be secured near the place where concrete pipes have been laid, for example, when corrections to a mating face must be made after the concrete pipes are laid in underdrain work, a wire saw can be passed around the concrete pipes by disposing a mobile machine having a cutting apparatus at the end of the boom and the arm of the mobile machine at a flat, high place and by lowering the boom and the arm to the concrete pipes laid in the underground. Therefore, a cutting operation can be performed in a relatively short time without consuming much time for arrangement.

In the method of the present invention for cutting a object to be cut by use of a wire saw by attaching a wire saw driving device to an acting end side of an arm of a mobile machine provided with a boom and the arm turnable and movable in upward, downward, leftward, rightward, forward, and backward directions, a base having the wire saw driving device is detachably attached to the end of the arm, a wire saw oil pressure driving device is used in which the base and the arm end are provided rotatably upon a shaft center and perpendicularly thereto and/or at an arbitrary angle therewith so that a rotational plane of a driving sheave of a wire saw of the wire saw driving device can be changed to be perpendicular thereto and/or at an arbitrary angle therewith, and the wire saw is driven while being set to have an arbitrary angle in accordance with an angle of the driving sheave, and looseness of the wire saw is removed under oil pressure control by finely adjusting the boom and the arm from a driver's seat when the wire saw is loosened. Therefore, as a matter of course, even in a situation in which a space wide enough to dispose a conventional concrete-cutting apparatus cannot be secured near the place where concrete pipes have been laid, for example, when corrections to a mating face must be made after the concrete pipes are laid in underdrain work, a wire saw can be passed around the concrete pipes by disposing a mobile machine having a cutting apparatus at the end of a boom and the arm of the mobile machine at a flat, high place and by lowering the boom and the arm to the concrete pipes laid in the underground. Therefore, a cutting operation can be performed in a relatively short time without consuming much time for arrangement. Additionally, since an optimum rotational plane can be secured by adjusting the rotational plane of the driving sheave, a decrease in the driving torque can be avoided by reducing the wear-out caused between the driving sheave and the wire saw.

Further, the present invention is the mobile machine provided with a cutting apparatuses, in which a wire saw cutting apparatus and a disk cutting apparatus are replaceably connected to an arm acting side of the mobile machine having a boom and an arm turnable and movable in upward, downward, leftward, rightward, forward, and backward directions, in which an oil hydraulic motor disposed in each of the cutting apparatuses is rotationally driven by an oil pressure driving source disposed in the mobile machine, and in which roll control and operations of the boom and the arm are also performed from a driver's seat disposed in the mobile machine. Therefore, when large and small secondary concrete products are cut, the disk type cutting apparatus is attached to the mobile machine to cut small concrete products, whereas a wire saw type cutting apparatus is attached to the mobile machine to cut large concrete products. Thus, a flexible countermeasure can be taken. Additionally, if the wire saw type cutting apparatus and the disk type cutting apparatus are prepared, the replacement of one of the cutting apparatuses to the other can be appropriately performed, and the work can be immediately restarted without stopping the work when the blade of one of the cutting apparatuses is worn down or broken by accident.

DESCRIPTION OF THE PREFERRED EMBODIMENT

Figure 1:
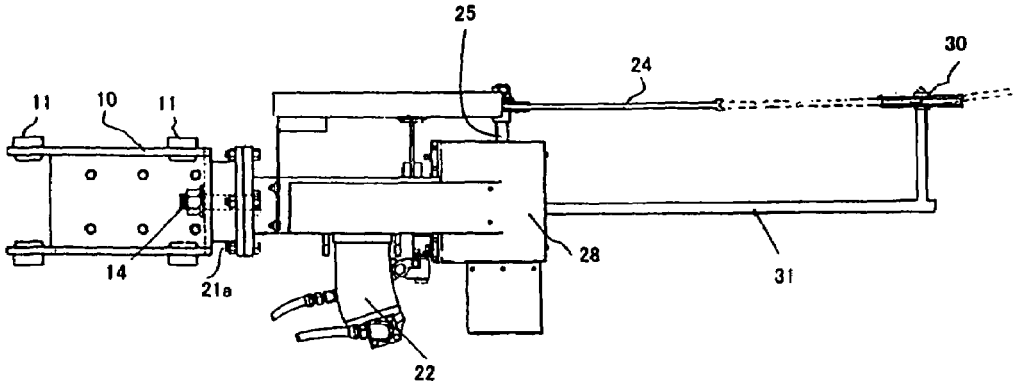
FIG. 1 is a plan view of a wire saw cutting machine of the present invention.
Figure 2:
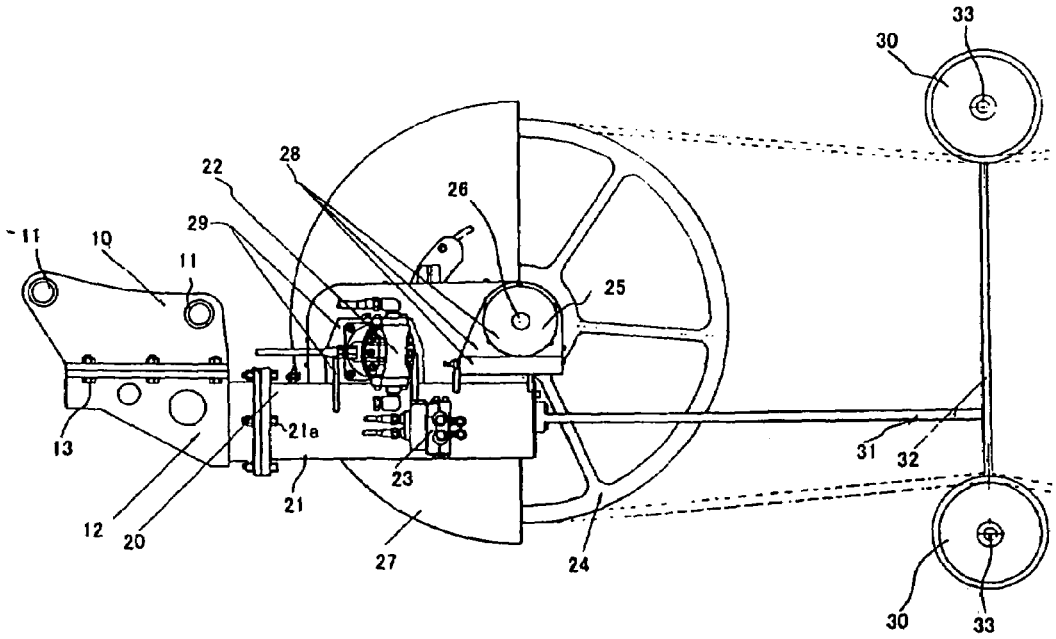
FIG. 2 is a side view of a wire saw cutting machine of FIG. 1.

FIG. 1 and FIG. 2 are a plan view and a side view, respectively, according to an embodiment of the present invention. In FIGS. 1 and 2, reference numeral 10 designates a bracket of a backhoe. The upper part of the bracket 10 has two shaft-supporting pinholes 11 bored in the lateral direction so as to coincide with pin-attaching holes bored in the end of an arm of the mobile machine, i.e., the backhoe, and the lower part of the bracket 10 is used as a bracket 12 by which a wire saw driving device described later is supported. The upper and lower parts thereof are fastened together with screws 13.

Reference numeral 20 designates the wire saw driving device. The wire saw driving device 20 includes a base 21, an oil hydraulic motor 22 serving as a driving motor, an oil pressure control valve 23, and a pillow bearing unit 25 that rotationally supports a main guide sheave 24 used to drive a wire saw. The oil hydraulic motor 22, the oil pressure control valve 23, and the pillow bearing unit 25 are disposed on the base 21.

As shown in FIG. 1, the lower part of the bracket 10 and the base 21 are fastened together with screws 21*a*. Attaching holes are bored in the bracket 10, whose direction has been fixed, so that the components provided on the side of the base 21 become rotatable upon the shaft center. The holes are appropriately bored as occasion demands. For example, four holes with intervals of an angle of 90 degrees or eight holes with intervals of an angle of 45 degrees are formed along the circumference so that screws are tightened through the holes. The angle can be set to be arbitrary as necessary. Reference numeral 14 designates a center bolt used to connect the bracket 10 and the base 21 together.

The oil hydraulic motor 22 is connected to an oil pressure pump in the backhoe through a pipe with the bracket 10 therebetween, and is rotationally driven. Roll control is performed by operating a valve provided at a driver's seat of the backhoe. The driving force of the oil hydraulic motor 22 is transmitted to a V belt pulley attached to a rotational shaft 26 of the pillow bearing unit 25 through a V belt, and is changed into a rotational force. The main guide sheave 24 fixed to the rotational shaft 26 is rotationally driven. A known wire saw onto the wire of which a granular diamond material has been fixed is wound around the main guide sheave 24. The wire saw can cut a object to be cut by obtaining a driving force from the rotational driving force of the oil hydraulic motor 22.

A cover 27 for safety is provided on the main guide sheave 24. Likewise, a cover 28 is provided on the driving belt.

A supporting stay 31 that supports sub-guide sheaves 30 of the wire saw is detachably attached to the end of the base 20, and extends therefrom. A bearing rod 32 is provided at the end of the supporting stay 31 so as to become perpendicular to the supporting stay 31. A bearing 33 that rotatably supports the sub-guide sheaves 30 is provided at the end of the bearing rod 32. The sub-guide sheaves 30 and the main guide sheave 24 are arranged so that grooves of these sheaves are aligned. The interval between the respective sub-guide sheaves 30 is set so that vibrations generated when the wire saw is driven can be absorbed.

FIG. 1 and FIG. 2 show a state in which the rotational shaft 26 is horizontally supported, and hence the sheave 24 is vertically placed. Therefore, the wire saw 40 cuts through the object to be cut in the vertical direction. To cut through the object in the horizontal direction, the screws 21*a* are first removed, and the base 21 is then rotated and moved by an angle of 90 degrees with respect to the bracket 10, and the screws 21*a* are tightened again.

Figure 3:
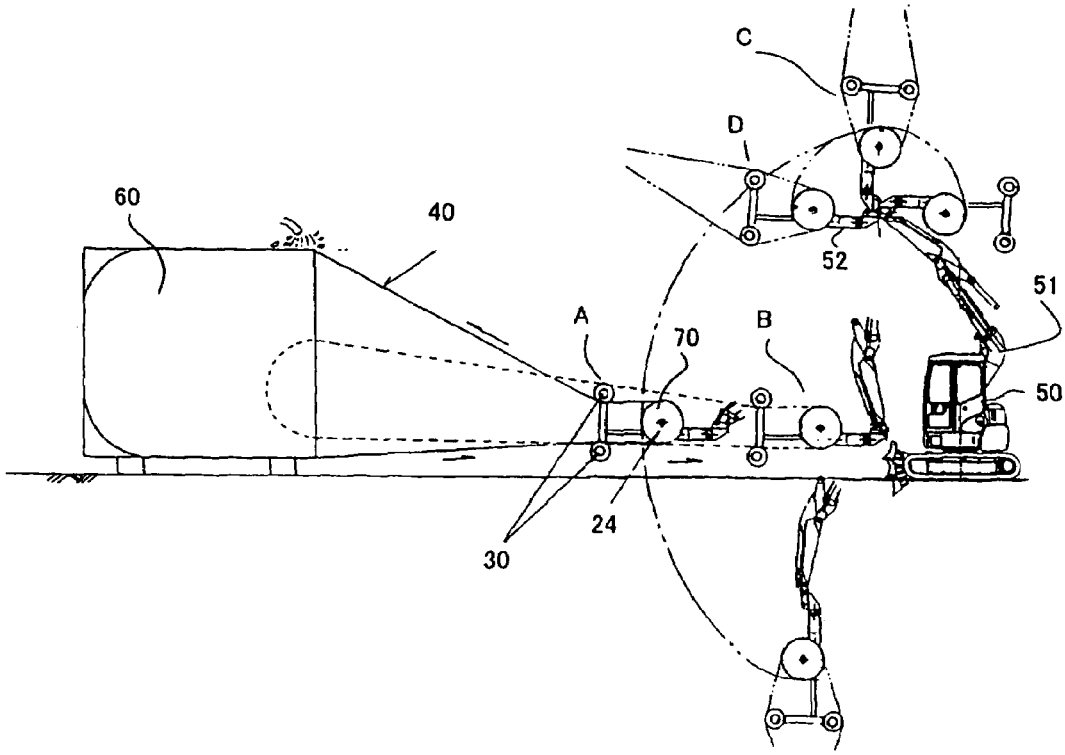
FIG. 3 is a side view of a first wire sawing method of the present invention.

FIG. 3 shows an example of the use of the cutting apparatus of the present invention. A boom 51 and an arm 52 of a backhoe 50 are pivotable on shaft-supporting pins, respectively. Therefore, a wire saw cutting apparatus 70 attached to the end of the arm 52 is disposed at an optimum position with respect to a object to be cut 60. One side of the wire saw 40 is passed around the object 60, whereas an opposite side thereof is passed around the main guide sheave 24 and the sub-guide sheaves 30. At this time, the boom 51 and the arm 52 of the backhoe 50 are thrust forward (position "A" in the FIG. 3), and the looseness of the wire saw is removed. After completing this initial setting, the oil hydraulic motor 22 is rotationally driven, and the wire saw 40 is moved at high speed by the handling from the driver's seat of the backhoe 50, thus starting the cutting operation. Proportionately with the progress of the cutting operation, the wire saw naturally becomes loose with respect to the object to be cut 60, and friction is lowered. Therefore, the boom 51 and the arm 52 are slightly operated to remove the looseness. Finally, the boom 51 and the arm 52 are further operated, and the main guide sheave 24 is drawn toward the backhoe 50 side (position "B" in the FIG. 3) with the progress of the cutting operation of the wire saw 40 at about the end of the cutting-operation period, thus making it possible to continue the cutting operation in the vertical direction until the completion of the cutting operation.

Therefore, the cutting operation of the wire saw is achieved by the wire saw driving device provided at the end position of the arm of the backhoe 50. Therefore, even if the wire saw is sharply bent, and a cutting accident occurs at about the end of the cutting-operation period, the wire saw can be prevented from being snapped and flying directly toward the operator so as to injure the operator, because the operator is present in the driver's seat of the backhoe 50.

The operation of cutting the object to be cut is completed only by moving the boom 51 and the arm 52 without moving the backhoe 50. If the cutting operation is not completed, the crawler is moved backwardly in the driver's seat together with the boom 51 and the arm 52, and the boom 51 and the arm 52 are returned to the original position (position "A" in the FIG. 3). As a result, the cutting operation of the wire saw can be performed again. In this case, even if the movement path of the backhoe 50 is unstable, the crawler can be smoothly moved, and hence the wire saw can stably cut the object.

Figure 4:
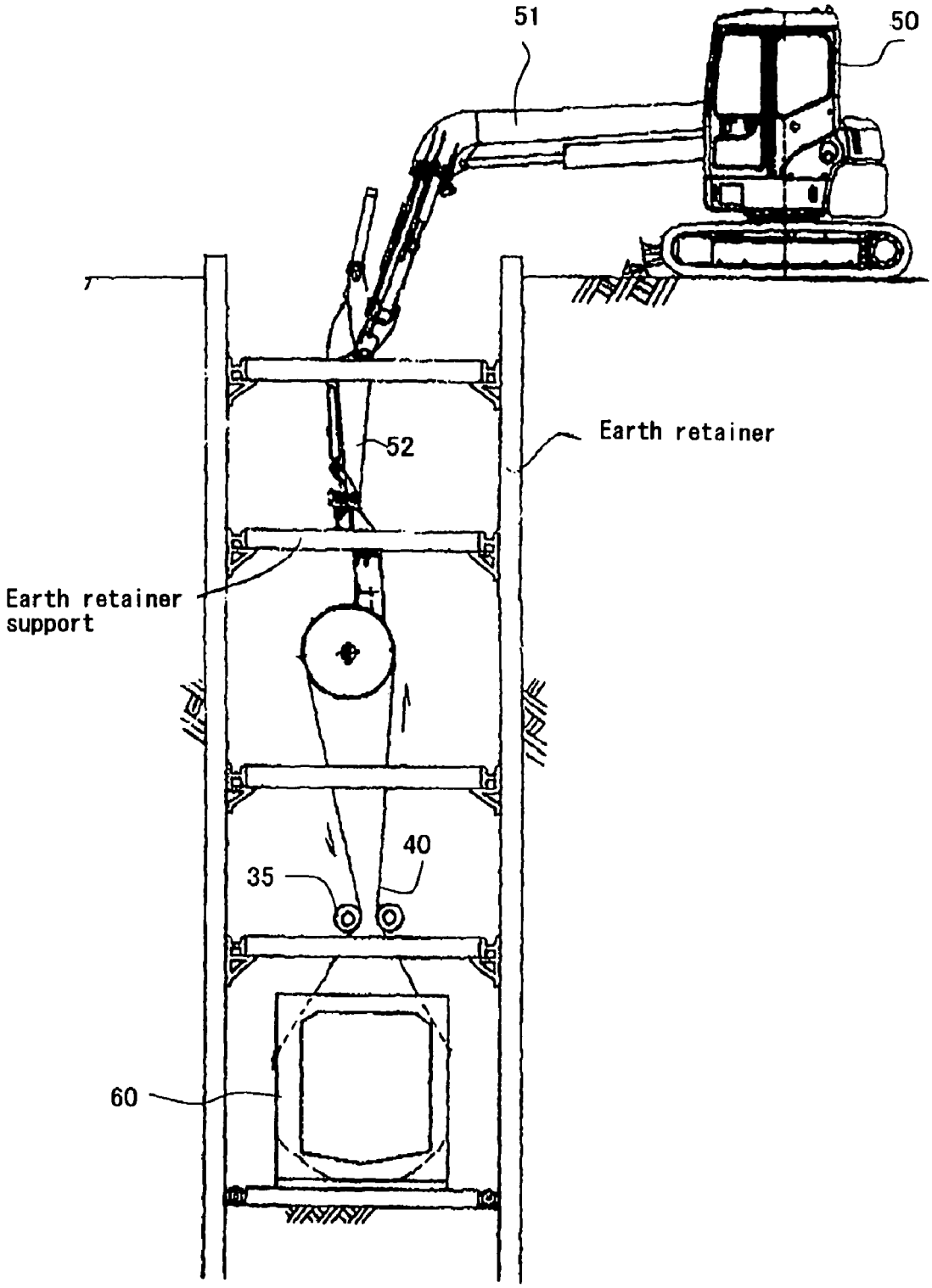
FIG. 4 is a sectional view of a second wire sawing method of the present invention.

Thereafter, when the object to be cut that is lower than the ground (or lower than a reference position) as shown in FIG. 4 is cut by use of the backhoe, the backhoe 50 is disposed at a flat place on the ground. The boom 51 and the arm 52 are then extended to the lower site where the object to be cut 60 is situated, and the wire saw drive cutting apparatus is appropriately disposed, thus performing a cutting operation. With the progress of the cutting operation of the wire saw 40, the wire saw 40 is naturally loosened. This looseness of the wire saw 40 can be removed by gradually moving the boom 51 and the arm 52 upwardly while operating these from the driver's seat. In this case, although the wire saw drive cutting apparatus is gradually moved upwardly, the cutting operation in the vertical direction can be performed without trouble.

In this case, the sub-guide sheave is detached, and a guide sheave 35 having the same function is fixed near the object to be cut. As a result, the wire saw 40 can be smoothly moved as desired.

An inclined surface can also be cut by appropriately adjusting the position of the sub-guide sheave 35.

In the apparatus of the present invention, if a object to be cut is situated at the bottom of a cliff, and a space wide enough to dispose the backhoe cannot be secured there, cases often occur in which the conventional wire saw cutting apparatus cannot be disposed near the object to be cut. Even in this situation, a cutting operation can be performed by disposing the backhoe at a flat place on the cliff and disposing the wire-saw driving and cutting apparatus while extending the boom and the arm to the lower site where the object to be cut is situated. Since the wire saw is naturally loosened with the progress of the cutting operation of the wire saw, the boom and the arm are gradually moved upwardly while being operated from the driver's seat. As a result, the looseness of the wire saw can be removed. At this time, the wire saw cutting apparatus is gradually moved upwardly. However, no trouble occurs, because the cutting operation is performed in the vertical direction.

Figure 5:
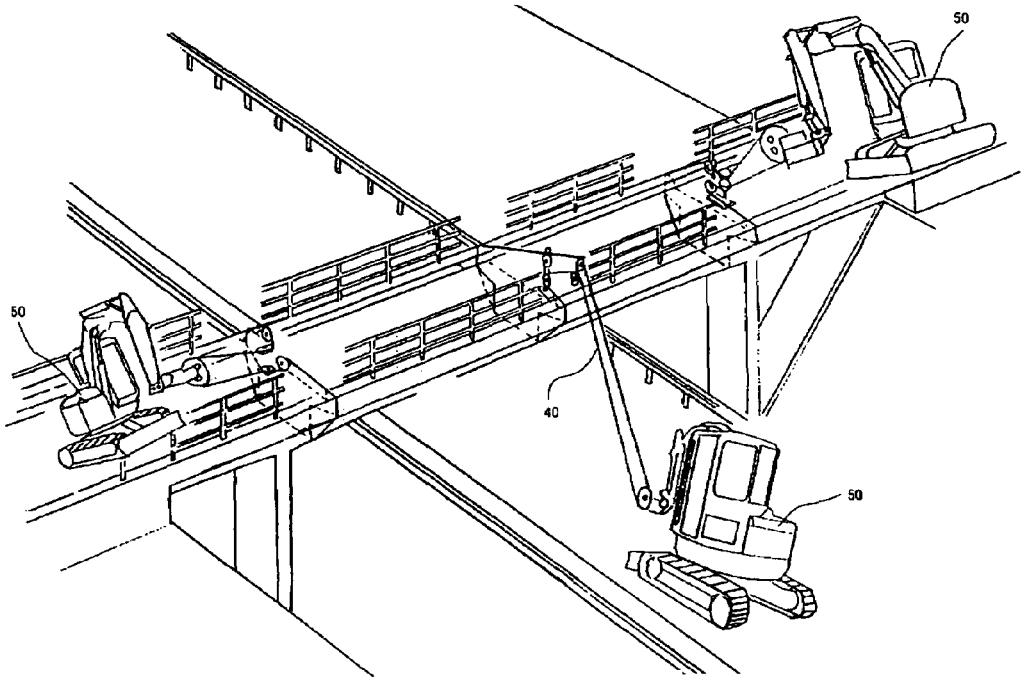
FIG. 5 is a perspective view of a third wire sawing method of the present invention.

When a cutting operation is performed by use of the wire saw in the repair work or removal work of a concrete bridge, the backhoe 50 is disposed on the side of a river area under the bridge, and the cutting apparatus is set so that the boom 51 and the arm 52 are located at the upper side, i.e., overhead as shown in FIG. 5 (for example, position "C" or "D" of FIG. 3). When the wire saw is loosened with the progress of the cutting operation, the looseness thereof can be removed by slightly operating the boom 51 and the arm 52. In this type of work, great care has been conventionally devoted to safety, and, for example, scaffolding has been put up on a large scale, and hence an enormous cost has been entailed. However, in this case, the employment of the apparatus of the present invention makes it unnecessary to put up such scaffolding, makes it unnecessary to perform the special operation of flattening the river area, and makes it unnecessary to lay rails as in the conventional way. Therefore, the period of construction can be shortened.

The present invention can be applied to the cutting of concrete pipes, the cutting of steel framed reinforced concrete wall surfaces, the cutting of underground structures, the cutting of sewage pipes, the cutting of tunnel wall surfaces, the cutting of expressway roadbeds, the cutting of underwater concrete structures, the cutting performed when bridges, elevated bridges, decommissioned nuclear reactors, etc., are pulled down, and the cutting of other rigid materials. Therefore, the present invention is industrially beneficial.

Although this invention is described in terms of specific embodiments, it is not limited thereto, as would be understood by those skilled in the art, numerous variations are possible wherein the scope of the invention, without departing from the sprit and nature thereof.

What is claimed is:

1. A wire saw cutting machine comprising:

a mobile machine including a pivotally supported boom and an arm pivotally supported by the boom, the arm having a distal end movable in three dimensions;

a wire saw mounted on the distal end of the arm for movement therewith, the wire saw comprising:

a base connected to the distal end of the arm and extending from the arm along a shaft center;

a drive sheave rotatably supported on the base;

a saw wire wrapped around the drive sheave and driven by the drive sheave for cutting along a cutting plane;

drive means for rotatably driving the drive sheave; and means for rotating the base, about the shaft center, relative to the distal end of the arm, to set the drive sheave and cutting plane at an arbitrary angle.

2. The wire saw cutting machine as claimed in claim 1 wherein the drive means is a hydraulic motor supported by the base, and wherein the mobile machine further includes an oil pressure source for operating the hydraulic motor.

3. The wire saw cutting machine as claimed in claim 1 further comprising sub-guide sheaves rotatably mounted on a support attached to the base, the saw wire being wrapped around the sub-guide sheaves in addition to the drive sheave.

4. The wire saw cutting machine as claimed in claim 3 wherein the support comprises a stay detachably attached to the base and a bearing rod mounted on a distal end of the stay perpendicular thereto, the sub-guide sheaves being rotatably mounted on opposing ends of the bearing rod.

5. The wire saw cutting machine as claimed in claim 3 wherein the drive sheave and the sub-guide sheaves have circumferential grooves, aligned with each other and receiving the saw wire.

6. The wire saw cutting machine as claimed in claim 1 wherein said shaft center extends horizontally and the drive sheave is vertical.

7. The wire saw cutting machine as claimed in claim 1 wherein said shaft center extends vertically and the drive sheave is horizontal.

8. The wire saw cutting machine as claimed in claim 1 wherein said shaft center is inclined and the drive sheave is inclined.

9. The wire saw cutting machine as claimed in claim 1 wherein the arm is turnable.

10. The wire saw cutting machine as claimed in claim 1 wherein the mobile machine is a crawler machine.

11. The wire saw cutting machine as claimed in claim 1 further comprising a bracket having one end pivotally attached to the distal end of the arm, wherein the base is connected to the distal end of the arm through the bracket and wherein the base extends along the shaft center from an end of the bracket opposite the one end.

12. The wire saw cutting machine as claimed in claim 1 wherein the means for rotating is a bolted coupling.

13. The wire saw cutting machine as claimed in claim 1 wherein the mobile machine is a backhoe.

* * * * *